United States Patent [19]

Torimitsu et al.

[11] Patent Number: 4,969,583

[45] Date of Patent: Nov. 13, 1990

[54] STORAGE BIN-TYPE ICE DISPENSER

[75] Inventors: Hiroshi Torimitsu; Jiro Yamamoto; Toshihiko Ishikawa; Masahide Yatori, all of Toyoake, Japan

[73] Assignee: Hoshizaki Denki Kabushiki Kaisha, Toyoake, Japan

[21] Appl. No.: 342,776

[22] Filed: Apr. 25, 1989

[30] Foreign Application Priority Data

| | | | |
|---|---|---|---|
| Apr. 25, 1988 | [JP] | Japan | 63-101572 |
| Apr. 25, 1988 | [JP] | Japan | 63-55548[U] |
| May 12, 1988 | [JP] | Japan | 63-62538[U] |
| May 12, 1988 | [JP] | Japan | 63-62539[U] |
| May 19, 1988 | [JP] | Japan | 63-66357[U] |

[51] Int. Cl.[5] ..... G01F 11/00

[52] U.S. Cl. ..... 222/272; 222/146.6; 222/273; 222/564

[58] Field of Search ..... 222/108, 237, 564, 239–242, 222/408, 410–414, 271–274, 146.6; 62/344

[56] References Cited

U.S. PATENT DOCUMENTS

| | | | |
|---|---|---|---|
| 3,225,968 | 12/1965 | Winkler et al. | 222/408 X |
| 3,387,750 | 6/1968 | Stencil | 222/410 X |
| 3,858,765 | 1/1975 | Landers | 222/413 |
| 3,889,853 | 6/1975 | Ribouleau | 222/273 X |
| 3,913,343 | 10/1975 | Rowland et al. | 222/241 X |
| 4,228,934 | 10/1980 | Carr | 222/412 |
| 4,512,502 | 4/1985 | Landers | 222/239 |

FOREIGN PATENT DOCUMENTS 62-9829 3/1987 Japan .

*Primary Examiner*—Kevin P. Shaver

*Attorney, Agent, or Firm*—Armstrong, Nikaido, Marmelstein, Kubovcik & Murray

[57] ABSTRACT

A storage bin type ice dispenser includes a storage bin having front and rear walls, opposed side walls, a bottom wall and an inclined wall formed between a lower end of the front wall and a front end of the bottom wall to form a semicylindrical internal surface extending upward from an internal surface of the bottom wall. The bin is formed therein with a guide groove which is located at the center portions of the bottom and inclined walls in a lateral direction and extends upward from the bottom wall to a lower part of the front wall. The guide groove is formed at a front part thereof with a dispensing opening which opens downward through the inclined wall. The ice dispenser further includes an agitator having a rotary shaft rotatably mounted within the bin and positioned laterally in parallel with the semicylindrical internal surface of the inclined wall. A finger assembly is mounted on the center of the shaft to rotate along the guide groove. A pair of axially opposed helical wire augers is provided on the shaft in a reverse pitch to push the ice cubes in the bin toward the finger assembly from the side walls during rotation of the shaft.

9 Claims, 3 Drawing Sheets

STORAGE BIN-TYPE ICE DISPENSER

BACKGROUND OF THE INVENTION

1. Field of the Invention

The present invention relates to storage bin-type ice dispensers for storing an amount of ice cubes therein and for dispensing the ice cubes therefrom on demand.

2. Description of the Prior Art

Disclosed in U.S. Pat. No. 4,512,502 granted to Landers is a storage bin-type ice dispenser which includes a semicylindrical bin arranged to store an amount of ice cubes therein, a cone-shaped wire auger mounted on a sloped axle between the end walls of the bin for agitating the ice cubes and for pushing the ice cubes along the bottom of the bin toward a dispensing opening in the front of the bottom wall, and radially extending fingers mounted on the axle to sweep the dispensing opening to break ice clusters near the fingers. In operation, a large flyte of the auger pushes the ice cubes from the rear of the pin toward the front of the bin where some of the ice cubes drop through the dispensing opening and some of the ice cubes are recirculated upward. In such an arrangement of the ice dispenser, a maximum guiding distance of the ice cubes becomes more than the axial length of the wire auger, resulting in (a) deterioration of the guiding efficiency of the ice cubes and (b) crushing of the ice cubes. Moreover, ice clusters near the dispensing opening may not be smoothly broken as the fingers are located adjacent the side walls of the bin.

Japanese Patent Publication No. 62-9829 discloses an ice dispenser of the type which includes a pair of parallel rotary shafts each having a pair of helical fins provided thereon in a reverse pitch and opposed to one another. The rotary shafts are mounted in a storage bin in such a manner that the helical fins are arranged to push ice cubes from the opposite end walls of the bin toward the center of the bin where a dispensing opening is provided to dispense some of the ice cubes therethrough. In such an arrangement of the rotary shafts, the ice cubes may not be smoothly dispensed only by the helical fins when the ice cubes are stuck together and form solid blocks or frozen clusters.

SUMMARY OF THE INVENTION

It is, therefore, a primary object of the present invention to provide an improved storage bin-type ice dispenser capable of smoothly dispensing ice cubes without causing of the ice cubes to be crushed even when the ice cubes are stuck together and form solid blocks or frozen clusters.

According to the present invention, the primary object is attained by providing a storage bin-type ice dispenser which comprises a storage bin having a front wall, a rear wall, a pair of opposed side walls, a bottom wall and an inclined wall formed between a lower end of the front wall and a front end of the bottom wall to form a semicylindrical internal surface extending upward from an internal surface of the bottom wall. The storage bin is formed therein with a guide groove which is located at central portions of the bottom and inclined walls in a lateral direction and extends upward from the bottom wall to a lower part of the front wall. The guide groove is formed at a front part thereof with a dispensing opening which opens downward through the inclined wall. An agitator include a rotary shaft rotatably mounted within the storage bin and positioned laterally in parallel with the semicylindrical internal surface of the inclined wall. A finger assembly is mounted on the center of the rotary shaft to rotate along the guide groove. A pair of axially opposed helical wire augers is provided on the rotary shaft in a reverse pitch to push the ice cubes in the bin toward the finger assembly from the side walls during rotation of the rotary shaft.

BRIEF DESCRIPTION OF THE DRAWINGS

Other objects, features and advantages of the present invention will be readily appreciated from the following detailed description of preferred embodiments thereof when considered with reference to the accompanying drawings, in which.

DESCRIPTION OF THE PREFERRED EMBODIMENTS

Figure 1:
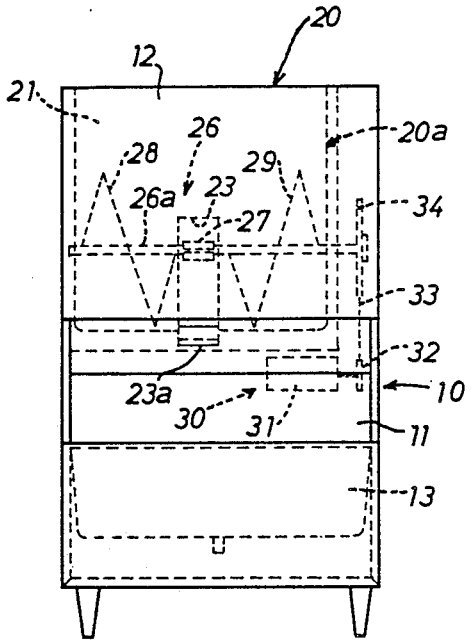
FIG. 1 is a front view of a storage bin-type ice dispenser in accordance with the present invention.
Figure 2:
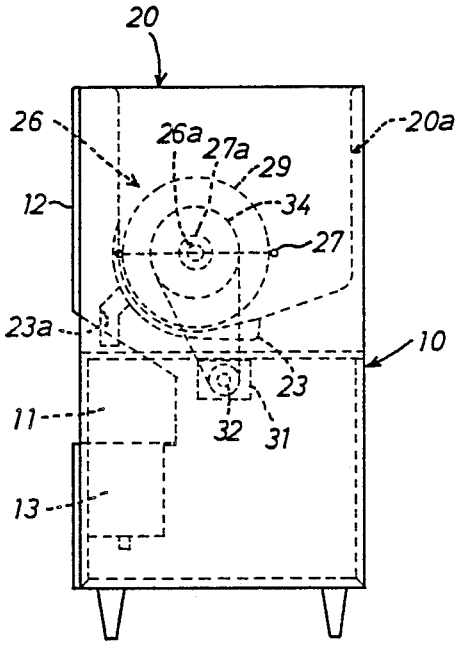
FIG. 2 is a side view of the ice dispenser shown in FIG. 1.
Figure 3:
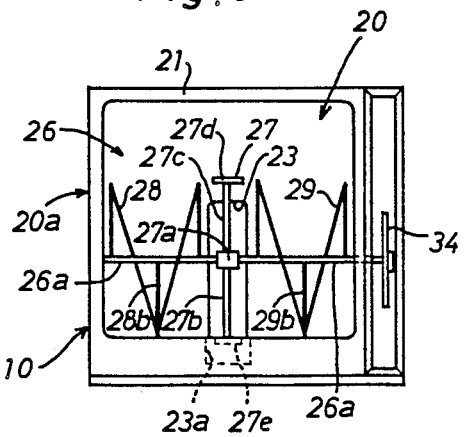
FIG. 3 is a plan view of the ice dispenser shown in FIG. 1.

In FIGS. 1–3 of the drawings, there is illustrated a storage bin-type ice dispenser which includes an ice storage bin 20 installed within an upper part of a box type cabient 10 to store therein a large amount of ice cubes. As shown clearly in FIG. 4, the ice storage bin 20 is composed of an internal casing **20*a* of hard synthetic resin which is assembled within an external metallic casing 20*b* through layers of insulating material. The ice storage bin 20 has a front wall 21, a bottom wall 22, a rear wall 24 and a pair of opposed side walls 25*a*, 25*b*. An inclined wall 21*a* is formed between the lower end of front wall 21 and the front end of bottom wall 22 to form a senicylindrical internal surface extending upward from an internal surface of bottom wall 22**.

Figure 4:
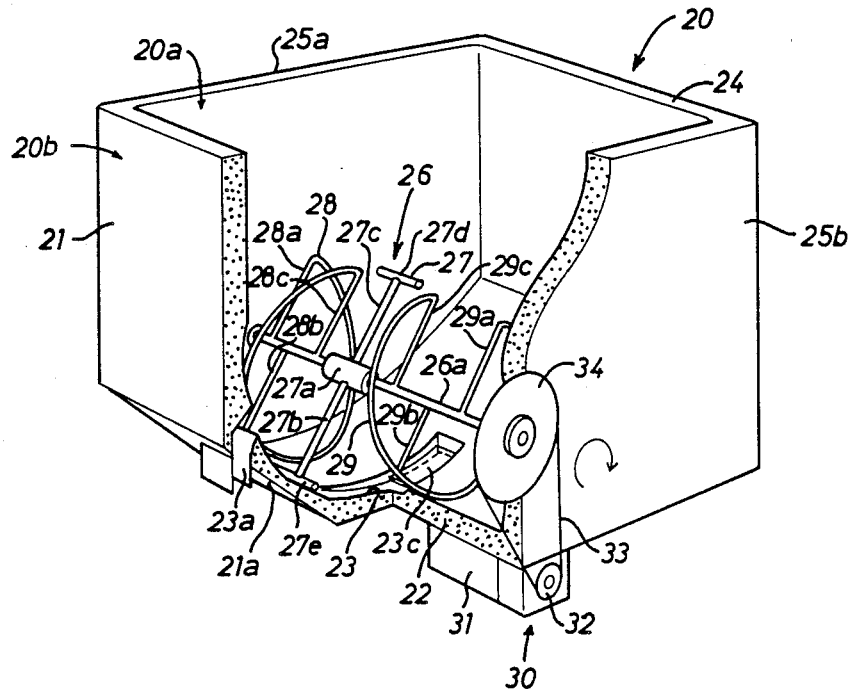
FIG. 4 is a partly broken perspective view illustrating an agitator arranged within the ice dispenser shown in FIG. 1.
Figure 5:
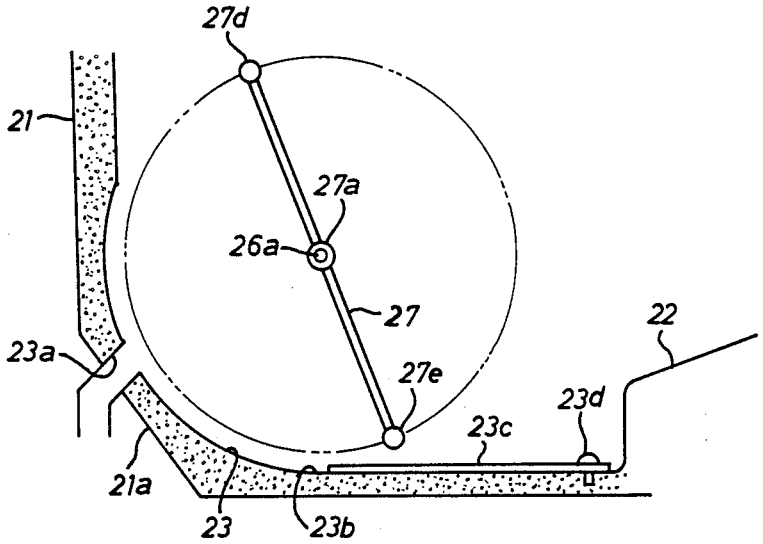
FIG. 5 is an enlarged sectional view illustrating a rotational locus of a finger assembly associated with the agitator in relation to a guide groove formed in a bottom of the storage bin shown in FIG. 4.

The internal casing **20*a* is formed with a guide groove 23 which is located at central portions of bottom wall 22 and inclined wall 21*a* in a lateral direction and extends upward from the bottom wall 22 to a lower part of front wall 21. The guide groove 23 has a semicylindrical front part and a straight rear part. The width and depth of guide groove 23 are determined to facilitate upward movement of ice cubes along the groove. The guide groove 23 is formed at its front part with a dispensing opening 23*a* which opens downwards into a takeout opening 11 of cabinet 10 through the inclined wall 21*a*. The cross-sectional area of dispensing opening 23*a* is determined to facilitate downward discharge of the ice cubes. As shown in FIGS. 4 and 5, an elongated rectangular reinforcement plate 23*c* of sheet metal is secured to a rear part of a bottom surface 23*b* of guide groove 23 by means of a fastening screw 23*d* threaded into the bottom wall 22 of bin 20**. The bottom surface of internal casing 20*a* is curved upwards toward the rear wall 24 ot facilitate forward movement of the ice cubes thereon.

An agitator 26 is arranged in the internal casing 20*a* in parallel with the inclined wall 21*a* of bin 20. The agitator 26 includes a rotary shaft 26*a* rotatably supported by a pair of axially spaced bearings carried on the side walls 25*a*, 25*b* of bin 20, a finger assembly 27 mounted on the center of rotary shaft 26*a*, and a pair of axially opposed helical wire augers 28, 29. The rotary shaft 26*a* is laterally positioned in parallel with the semicylinderical internal surface of inclined wall 21*a* in such a manner that the axis of shaft 26*a* coincides with the center of a semicircle defined by the bottom surface 23*b* of guide groove 23. The rotary shaft 26*a* spaced from the rear wall 24 of bin 20 and positioned near the front wall 21 of bin 20 in such a manner that the axis of shaft 26*a* is located above the front end of the reinforcement plate 23*c* as shown in FIG. 5. In a practical embodiment of the present invention, it is preferable that the rotary shaft 26*a* is composed of an inner shaft rotatably mounted within the storage bin 20 and an outer shaft coaxially connected to the inner shaft for rotation therewith and for supporting thereon such a driven sprocket as shown in FIG. 4.

The finger assembly 27 includes a hub sleeve 27*a* secured to the center of shaft 26*a*, a pair of circumferentially spaced radical support arms 27*b*, 27*c* press-fitted in radial holes of sleeve 27*a* and welded to the holes, and a pair of lateral fingers 27*d*, 27*e* welded to the distal ends of support arms 27*b*, 27*c*, respectively in a T-letter form. The length of arms 27*b*, 27*c* and width of fingers 27*d*, 27*e* are each determined to allow rotary motion of the fingers 27*d*, 27*e* along the guide groove 23 during rotation of the shaft 26. In addition, as shown by an imaginary line in FIG. 5, a predetermined space is provided between thè semicylindrical front part of guide groove 23 and a circle defined by rotary motion of lateral fingers 27*d*, 27*e*.

As shown in FIGS. 2–3, the helical wire augers 28, 29 are provided respectively on the left-hand and right-hand portions of shaft 26. The left-hand wire auger 28 has inner and outer rod portions 28*c*, 28*a* which are welded at their inner ends to the rotary shaft 26*a* to extend radially in parallel from the rotary shaft 26*a*. An intermediate portion of wire auger 28 is supported by a radial rod 28*b* which is welded at its inner end to the rotary shaft 26*a* to extend in an opposite direction wiht respect to the rod portions 28*a*, 28*c* of wire auger 28. Similarly, the right-hand wire auger 29 has inner and outer rod portions 29*c*, 29*a* which are welded at their inner ends to the rotary shaft 26*a* to extend radially in parallel from the rotary shaft 26*a* in the same direction as the rod portions 28*a*, 28*c* of wire auger 28. An intermediate portion of wire aguer 29 is supported by a radial rod 29*b* which is welded at its inner end to the rotary shaft 26*a* to extend in an opposite direction with respect to the rod portions 29*a*, 29*c* of wire auger 29. In such an arrangement of wire aguers 28, 29, the rod portions 28*a*, 28*b*, 28*c* and 29*a*, 29*b*, 29*c* are positioned in a common plane defined by the rotary shaft 26*a* and support arms 27*b*, 27*c* of finger assembly 27. In addition, the wire augers 28, 29 are formed in a reverse pitch to push the ice cubes toward the center of shaft 26*a* from the side walls 25*a*, 25*b* during rotation of shaft 26*a*.

As shown in FIGS. 1–4, a drive mechanism 30 of the agitator 26 includes an electric geared motor 31 attached to the bottom wall 22 of bin 20, a drive sprocket 32 mounted on an output shaft of motor 31, and a driven sprocket 34 fixed to an outer end of rotary shaft 26*a* and being drivingly connected to the drive sprocket 32 by means of a drive chain 33. The geared motor 31 is arranged to be energized when a power switch (not shown) on a front panel 12 of cabinet 10 has been turned on. In addition, the reference numberal 13 indicates an ice receiver mounted within a lower portion of cabinet 10 and located below the take-out opening 11 to receive the ice cubes discharged from the dispensing opening 23*a*.

In use of the ice dispenser, a large amount of ice cubes are stored in the internal casing 20*a* of bin 20 at low freezing temperatures. Upon demand, the power switch is turned on to energize the geared motor 31 and in turn, the rotary shaft 26*a* of agitator 26 is driven by the motor 31 to rotate the wire augers 28, 29 in a clockwise direction. Thus, the wire aguers 28, 29 agitate the ice cubes positioned adjacent thereto in casing 20*a* and push them toward the center of rotary shaft 26*a* from the side walls 25*a*, 25*b* of casing 20*a*. The ice cubes pushed by wire augers 28, 29 drop into the guide groove 23 and are successively picked up by the lateral fingers 27*d*, 27*e* of assembly 27 along the guide groove 23 to drop into a prepared cup (not shown) in the take-out opening 11 through the dispensing opening 23*a*. In this instance, the upwardly curved rear bottom surface of internal casing 20*a* causes the ice cubes to move down toward the front of the storage bin so that they are smoothly picked up by the lateral fingers 27*d*, 27*e* of assembly 27.

In a condition where the ice cubes in the storage bin 20 are struck together and form blocks or clusters, the wire augers 28, 29 cooperate with the finger assembly 27 to push up the clusters along the semicylindrical internal surface of inclinded wall 21*a*. In this instance, the clusters are forcibly pushed up by the rod portions 28*a*–28*c* and 29*a*–29*c* of wire aguers 28 and 29 which cooperate with the support arms 27*b* and 27*c* of finger assembly 27. After being pushed up to a highest position, the clusters drop on the ice cubes remaining in the rear portion of the bin and tend to be broken by abutment against the ice cubes. After such an operation has been repeated, the clusters are separated into the original ice cubes, and in turn, the separated ice cubes drop into the prepared cup in the same manner as described above. Thus, the ice cubes are smoothly dispensed from the storage bin without causing the ice cubes to be crushed even when the ice cubes stick together and form solid blocks or frozen chusters.

During rotation of the shaft 26*a* in the clockwise direction, the ice cubes tend to be cut into a space between the lateral fingers 27*d*, 27*e* of finger assembly 27 and the reinformcement plate 23*c*. Even if the ice cubes were cut into the space, the reinforcement plate 23*c* would receive a thrust force applied thereto from the ice cubes to protect the bottom surface 23*b* of guide groove 23 from defacement or damage. When it is desired to wash the guide groove 23, the screw 23*d* is unthreaded to remove the reinforcement plate 23*c*. With the agitator 26, the guiding distance fo the ice cubes can be shortened in about half of the axial length of rotary shaft 26*a*, and the ice cubes guided into the center of shaft 26*a* are pushed forward along the guide groove 23 by means of the finger assembly 27. This is also effective to prevent crushing of the ice cubes.

Figure 6:
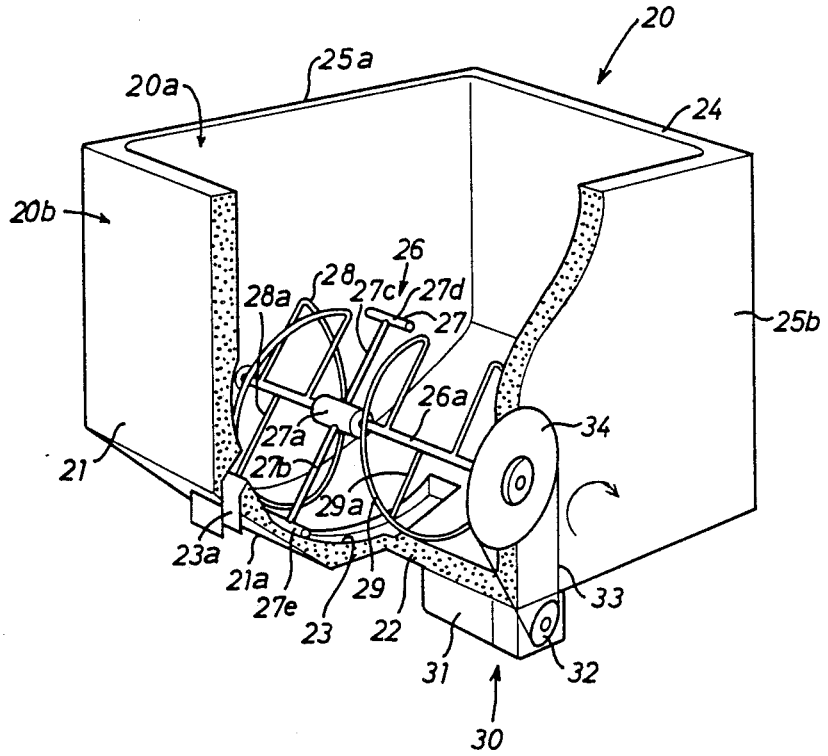
FIG. 6 is a partly broken perspective view of a modification of the ice dispenser shown in FIG. 4.
Figure 7:
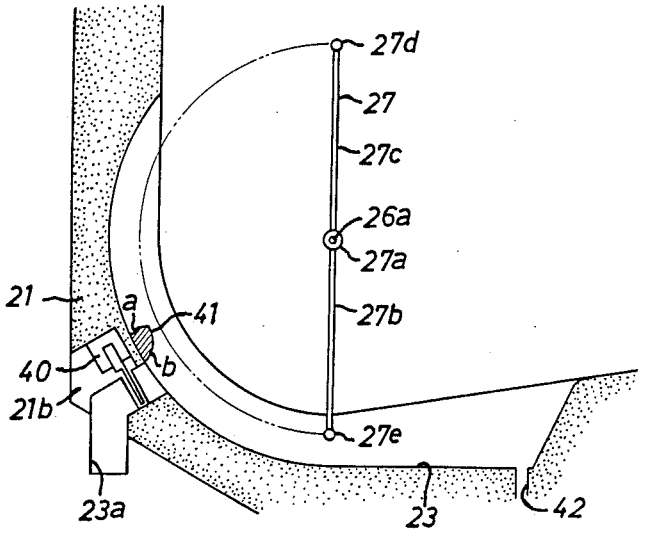
FIG. 7 is an enlarged sectional view illustrating a rotational locus of a finger assembly associated with an agitator in relation to a guide groove shown in FIG. 6.

Disclosed in FIGS. 6 and 7 is a modification of the ice dispenser in which the dispensing opening 23*a* is formed narrower in width than the guide groove 23, a shutter 40 is mounted within a recessed portion 21*b* formed in the lower end of front wall 21 adjacent the dispensing opening 23*a*, a projection 41 is provided on the bottom surface of guide groove 23, and a drain hole 42 is formed in the rear end of guide groove 23. The shutter 40 is arranged to be opened and closed under control of an operation mechanism (not shown). The projection 41 is located above the inner end of dispensing opening 23*a* and has the same width as that of the dispensing opening 23*a*. The upper and lowerr surfaces a and b of projection 41 are each curved downward as shown in the FIG. 7.

During operation of the agitator 26 in the modified ice dispenser, water of molten ice cubes flows down along the internal surface of front wall 21 and the upper portion of guide groove 23 and is received by the upper surface a of projection 41. Thus, the projection 41 prevents entry of the water into the dispensing opening 23*a* and causes the water to flow into the drain hole 42 through the opposite sides of guide groove 23. This is useful to prevent refreeze of the water in the storage bin and to prevent the water from dropping from the dispensing opening 23*a*. Furthermore, the projection 41 is effective to break the ice clusters pushed up by the finger assembly 27 and to minimize heaps of the ice cubes at a portion adjacent the inner end of dispensing opening 23.

While the invention has been described with reference to specific embodiments, modifications and variations of the inventionl may be constructed without departing from the scope of the appended claims.

What is claimed is:

1. A storage bin type ice dispenser comprising:

a storage bin having a front wall, a rear wall, a pair of opposed side walls, a bottom wall and an inclined wall formed between a lower end of the front wall and a front end of the bottom wall to form a semicylindrical internal surface extending upward from an internal surface of the bottom wall, an internal surface of said bottom wall is curved upward toward said rear wall, said storage bin formed therein with a guide groove which is located at central portions of the bottom and inclined walls in a lateral direction and extends upward from an intermediate part of the bottom wall to a lower part of the front wall, said guide groove formed at a front part thereof with a dispensing opening which opens downward through the inclined wall; and an agitator arranged within said storage bin and being upwardly exposed to ice cubes stored in said storage bin, said agitator including (a) a rotary shaft rotatably mounted within said storage bin and positioned laterally in parallel with the semicylindrical internal surface of the inclined wall, said rotary shaft spaced a predetermined distance from said rear wall and positioned near said front wall such that an axis of said rotary shaft is located above said guide groove, (b) a finger assembly mounted on a center of said rotary shaft for rotation therewith along a bottom surface of said guide groove in said storage bin, said finger assembly includes at least one radial support arm, secured at an inner end to a center of said rotary shaft, and at least one lateral finger secured to a distal end of said at least one radial support arm in a form of a letter T to rotate along the bottom surface of the guide groove, and (c) a pair of axially opposed helical wire augers provided on said rotary shaft in a reverse pitch to push the ice cubes in said storage bin toward said finger assembly from the side walls during rotation of said rotary shaft.

2. An ice dispenser as claimed in claim 1, wherein a reinforcement plate is secured to a rear part of the bottom surface of said guide groove, and wherein said rotary shaft of said agitator is positioned near said front wall such that the axis of the rotary shaft is located above a front end of said reinforcement plate.

3. An ice dispenser as claimed in claim 1, wherein said finger assembly of said agitator includes a pair of circumferentially spaced radial support arms secured at respective inner ends to the center of said rotary shaft, and a pair of lateral fingers secured to the distal ends of the radial support arms, respectively in the form of a letter T, to rotate along the bottom surface of said guide groove.

4. An ice dispenser as claimed in claim 3, wherein said helical wire augers each have inner and outer rod portions secured at respective inner ends to said rotary shaft in parallel with one of the support arms of said finger assembly and an intermediate portion supported by a radial rod secured at an inner end to said rotary shaft in an opposite direction with respect to the rod portions.

5. A storage bin type ice dispenser comprising:

a storage bin having a front wall, a rear wall, a pair of opposed side walls, a bottom wall and an inclined wall formed between a lower end of the front wall and a front end of the bottom wall to form a semicylindrical internal surface extending upward from an internal surface of the bottom wall, said storage bin formed therein with a guide groove which is located at central portions of said bottom and inclined walls in a lateral direction and extends upward from an intermediate part of said bottom wall to a lower part of said front wall, said guide groove formed at a front part thereof with a dispensing opening which opens downward through said inclined wall, a projection is provided on a bottom surface of said guide groove at a position above an inner end of said dispensing opening to receive water of molten ice flowing down from said front wall; and an agitator arranged within said storage bin and being upwardly exposed to ice cubes stored in said storage bin, said agitator including (a) a rotary shaft rotatably mounted within said storage bin and positioned laterally in parallel with the semicylindrical internal surface of said inclined wall, (b) a finger assembly mounted on a center of said rotary shaft for rotation therewith along said guide groove, and (c) a pair of axially opposed helical wire augers provided on said rotary shaft in a reverse pitch to push ice cubes in said storage bin toward said finger assembly from said side walls during rotation of said rotary shaft.

6. An ice dispenser as claimed in claim 5, wherein a drain hole is formed in the rear end of said guide groove to discharge the water flowing thereinto from said projection.

7. An ice dispenser as claimed in claim 5, wherein said dispensing opening is formed narrower in width than said guide groove and said projection has a same width as that of said dispensing opening.

8., A storage bin type ice dispenser comprising:

a storage bin having a front wall, a rear wall, a pair of opposed side walls, a bottom wall and an inclined wall formed between a lower end of the front wall and a front end of the bottom wall to form a semicylindrical internal surface extending upward from an internal surface of the bottom wall, an internal surface of said bottom wall is curved upward toward said rear wall, said storage bin formed therein with a guide groove which is located at central portions of the bottom and inclined walls in a lateral direction and extends upward from an intermediate part of the bottom wall to a lower part of the front wall, the guide groove having a semicylindrical front part and a straight rear part and is formed at the semicylindrical front part thereof and with a dispensing opening which opens downward through the inclined wall; and an agitator arranged within said storage bin and being upwardly exposed to ice cubes stored in said storage bin, said agitator including (a) a rotary shaft rotatably mounted within said storage bin and positioned laterally in parallel with the semicylindrical internal surface of the inclined wall, said rotary shaft of said agitator is spaced in a predetermined distance from said rear wall and positioned near said front wall such that the axis of said rotary shaft is located above a front end of the straight rear part of said guide groove, (b) a finger assembly mounted on a center of said rotary shaft for rotation therewith along the semicylindrical front part of said guide groove in said storage bin, and said finger assembly of said agitator includes a plurality of circumferentially spaced radial support arms secured at inner ends to the center of said rotary shaft and a plurality of lateral fingers secured to the distance ends of said support arms to rotate along the semicylindrical front part of said guide groove and (c) a pair of axially opposed helical wire augers provided on said rotary shaft in a reverse pitch to push the ice cubes in said storage bin toward said finger assembly from the side walls during rotation of said rotary shaft.

9. An ice dispenser as claimed in claim 8, wherein a reinformecement plate is secured to the straight rear part of said guide groove, and wherein said rotary shaft of said agitator is positioned near said front wall such that the axis of said rotary shaft is located above a front end of said reinforcement plate.

* * * * *